US006536703B2

(12) United States Patent
Gagnon

(10) Patent No.: US 6,536,703 B2
(45) Date of Patent: Mar. 25, 2003

(54) CORE SLIP DRUM

(75) Inventor: Jeffrey A. Gagnon, Hartford County, CT (US)

(73) Assignee: Coil Pro Machinery, Inc., Southington, CT (US)

( * ) Notice: Subject to any disclaimer, the term of this patent is extended or adjusted under 35 U.S.C. 154(b) by 0 days.

(21) Appl. No.: 09/793,086

(22) Filed: Feb. 27, 2001

(65) Prior Publication Data

US 2002/0117576 A1 Aug. 29, 2002

(51) Int. Cl.[7] ..... B65H 18/10

(52) U.S. Cl. ..... 242/530.3; 242/545.1; 242/908

(58) Field of Search ..... 242/530.3, 908, 242/545.1

(56) References Cited

U.S. PATENT DOCUMENTS 2,798,677 A * 7/1957 Nicholson ..... 242/530.3
3,182,924 A * 5/1965 Jones et al.
3,830,143 A * 8/1974 Dowd ..... 242/908
3,853,280 A * 12/1974 Pennisi et al. ..... 242/530.3
5,252,369 A * 10/1993 Akao et al. ..... 242/613.5
5,292,084 A * 3/1994 Lofstrom ..... 242/530.3
5,816,525 A * 10/1998 De Roeck ..... 242/908
5,908,171 A * 6/1999 Raudaskoski ..... 242/530.3

FOREIGN PATENT DOCUMENTS

DE 3729448 * 8/1989 ..... 242/908

* cited by examiner

*Primary Examiner*—John M. Jillions
(74) *Attorney, Agent, or Firm*—Collier Shannon Scott, PLLC; David R. Yohannan; Mark W. Rygiel

(57) ABSTRACT

A method and apparatus for winding strip material onto a drum is disclosed. Friction between the surface of the drum and the strip material wound there around, as well as friction between adjacent reels of strip material, may be selectively controlled by controlling the provision of a fluid bed between the strip material and the surface of the drum. Control over this friction allows the individual strips to slip to different degrees relative to the drum on which they are wound. The different amounts of slip permit the strips to be wound on the drum with uniform tension and at a uniform take up speed.

28 Claims, 5 Drawing Sheets

CORE SLIP DRUM

FIELD OF THE INVENTION

The present invention relates to an apparatus for winding parallel strips of material, such as metal strips, onto a drum.

BACKGROUND OF THE INVENTION

Thin strips of material, such as steel, may be formed by slitting a wide web of material into a number of thin strips. For purposes of storage and shipping convenience, these thin strips of material may be wound onto a drum immediately following the slitting process. FIG. 1 shows three thin strips 20 of material, which have been slit downstream from a continuous web of material (not shown), being wound onto a drum 100 to form separate reels of thin strip material.

Because all thin strips 20 of material wound onto the drum 100 originate from the same wide web of material, it is desirable for all of the strips to be wound onto the drum at the same rate. If the strips 20 are not wound at the same rate, one of two conditions may occur. Winding a strip 20 at a rate that is slower than that of another reel on the drum may produce slack in the more slowly wound strip. Such slack may cause the strip 20 to be wound more loosely than is desired, and result in a drum with nonuniform reels of wound material. In extreme cases, such slack may accumulate to the point that it drags on the floor, or requires the creation of a large pit for accommodation of the slack. Alternatively, winding a strip 20 at a higher rate than other reels may produce excess tension in the more quickly wound strip. This tension may cause the strip to be wound too tightly, or in extreme situations cause damage to the strip or the apparatus used for the winding operation.

One hypothetical method of ensuring that all the strips are wound on a drum with uniform tension and at a uniform speed would be to make sure that all of the reels have the same thickness "d" throughout the winding process. Reels with the same thickness inherently take up thin strip material at the same speed. As shown in FIG. 1, however, it is not uncommon for the neighboring reels of thin strip material to have different thickness "d." The production of reels with different thicknesses on the same drum may occur as a result of any of the following in isolation or combination: uneven wide web thickness, uneven coating thickness on the wide web, excessive/uneven burr on the wound strips, a loose leading strip edge, uneven applications of slitting lubricant, etc. Thus, it is not uncommon for the "natural" rate of strip take up to be different for the various reels on a drum.

It has been determined, however, that the "natural" rate of strip take up for each individual reel of strip material may be modified by providing for slip between the reel and the drum on which it is wound. In other words, the rate of take up of each individual strip may be controlled.

One known method of controlling the take up speed of each strip on a drum is described in, Lofstrom, Roger J., *The Benefits and Limitations of Coreslip Rewinding*, The Fabricator, October 1995, which is incorporated by reference herein. The afore noted article describes a Coreslip rewinding system in which the winding drum includes a number of outer drive rings on its outer surface. Each thin strip of material may be wound onto a separate drive ring. The drive rings may be made of plastic material, which provides them with the ability to slip relative to each other and the drum that drives them. The amount of "slip" of the drive rings is adjusted by adjusting the lateral pressure applied to the rings. The tighter the drive rings are squeezed together, the greater the friction between them, and the less they slip. By selectively adjusting the lateral pressure applied to the rings, the relative slip may be set so that each thin strip of material is wound under a relatively uniform tension.

While the foregoing Coreslip device provides the needed slip between adjacent reels, it does so at a cost. The plastic drive rings are susceptible to wear and heat, and may need to be changed frequently, raising cost and maintenance concerns. Furthermore, because each strip of material is subjected to the same amount of tension force, the strips must be of comparable width to avoid excessive loading of narrower strips.

Another known method of controlling strip take up speed is described in Lofstrom, U.S. Pat. No. 5,292,084 (Mar. 8, 1994). The Lofstrom patent discloses a core slip rewinding system in which each individual strip is wound over a series of roller bearings. The roller bearings underlying each reel are free to rotate independent of the neighboring roller bearings of other reels. As such this system may be capable of reducing the friction between the reels and the drum to near zero levels. Although this system may be very effective, it suffers from being relatively expensive to manufacture compared to alternatives. Furthermore, such a system can only accommodate one size of drum.

Upon study of the foregoing Lofstrom devices, it became apparent to the present Applicant that a preferable winding apparatus would provide near zero friction between the wound material and the core on which it is wound. Any friction that is needed to control the amount of slip between the wound material and the core may be provided by laterally squeezing the strips of wound material together. By limiting the friction providing component to one parameter, precise control may be exercised over the amount of relative slip between the strips of wound material. While the later Lofstrom device provides the low friction required, it does so at the cost of monetary expense and limited versatility.

Therefore, there is a need for a method and apparatus for winding strip material that is more economical to produce and maintain than previously known systems. There is also a need for a method and apparatus for winding that is easier to operate, able to accommodate a wider selection of drum sizes, and does not require a slack pit. There is also a need for such a system that provides improved control over the relative slip between strips of wound material using lateral pressure.

In response to these needs, the present applicant has developed a method and apparatus for winding strip material on a drum which differs from the systems described above. In a first embodiment of the applicant's invention, a cushion of fluid, preferably air, may be selectively provided between the winding drum and the strip material wound thereon to reduce the friction there between.

OBJECT OF THE INVENTION

It is therefore an object of the present invention to provide a method and apparatus for reducing friction and/or controlling the amount of friction between a winding drum and the material wound thereon or therearound.

It is another object of the present invention to provide a method and apparatus for selectively adjusting the amount of slip between a winding drum and a reel of wound material.

It is still another object of the present invention to provide a method and apparatus for reducing friction and/or controlling the amount of friction between individual strips of material wound on a winding drum.

It is yet another object of the present invention to provide a method and apparatus for winding strip material that is more economical than previous methods and apparatuses.

It is still yet another object of the present invention to provide a method and apparatus for winding strip material that requires less maintenance than previous methods and apparatuses.

It is still another object of the present invention to provide a method and apparatus for winding strip material that can accommodate different sized winding drums.

It is still another object of the present invention to provide a method and apparatus for supplying a bed of pressurized fluid between the outer surface of a winding drum and material wound thereon.

It is still yet another object of the present invention to provide a method and apparatus for controlling the pressure of a fluid provided between the outer surface of a winding drum and material wound thereon.

Additional objects and advantages of the invention are set forth, in part, in the description which follows, and, in part, will be apparent to one of ordinary skill in the art from the description and/or from the practice of the invention.

SUMMARY OF THE INVENTION

In response to the foregoing challenges, applicant has developed an innovative apparatus for winding strips of material comprising: a drum adapted to rotate about a longitudinal axis, said drum having a winding surface; a plurality of openings provided in the drum winding surface; and a means for supplying pressurized fluid to the openings.

Applicant has further developed an innovative apparatus for winding strips of material fed to the apparatus from a slitting machine, said apparatus comprising: a rotary arbor; a drum having an interior and a winding surface, said drum removably mounted on the rotary arbor; a plurality of openings providing communication between the drum interior and the drum winding surface; a pressurized fluid source; and at least one pressurized fluid passage connecting the pressurized fluid source to the openings.

Applicant has still further developed an innovative method of controlling the amount of friction between the winding surface of a drum and a plurality of material strips wound around said drum, said method comprising the steps of: providing a core insert around the drum winding surface; winding a strip of material around the core insert; and providing fluid between the winding surface and the core insert.

Applicant has still yet further developed an innovative method of reducing the amount of friction between the winding surface of a drum and a plurality of material strands wound around said drum, said method comprising the steps of: winding at least two strands of material around the drum winding surface; and supplying above ambient pressurized fluid to the winding surface.

It is to be understood that both the foregoing general description and the following detailed description are exemplary and explanatory only, and are not restrictive of the invention as claimed. The accompanying drawings, which are incorporated herein by reference and which constitute a part of this specification, illustrate certain embodiments of the invention, and together with the detailed description serve to explain the principles of the present invention.

BRIEF DESCRIPTION OF THE DRAWINGS

The invention will be described in conjunction with the following drawings in which like reference numerals designate like elements and wherein.

DETAILED DESCRIPTION OF THE INVENTION

Figure 1:
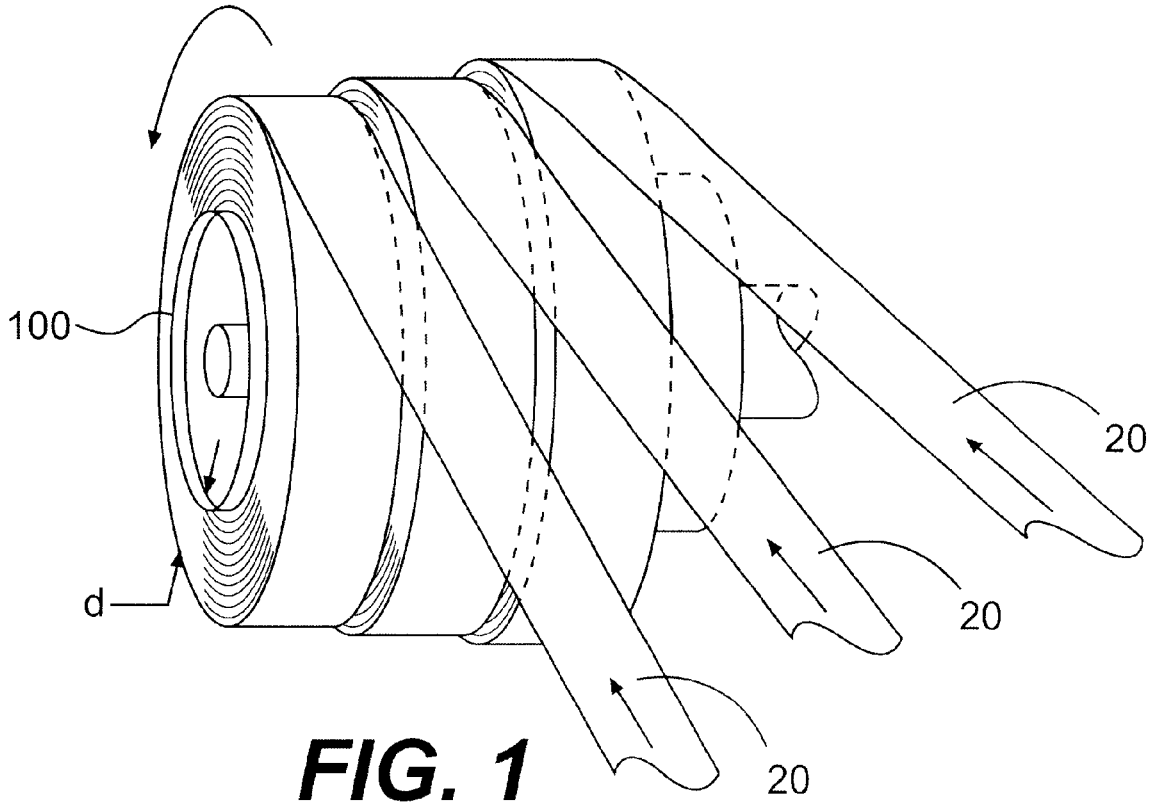
FIG. 1 is a pictorial view of three strips of material being wound onto a drum operated in accordance with the present invention.
Figure 2:
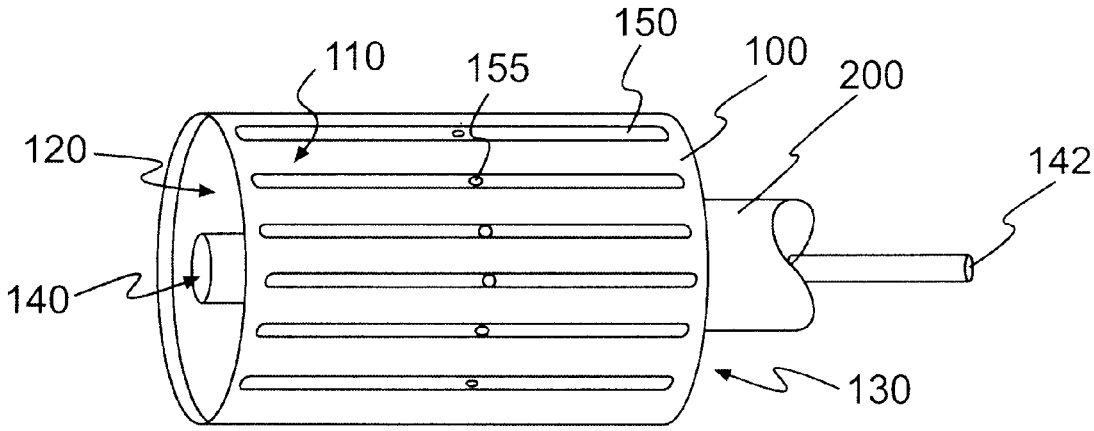
FIG. 2 is a pictorial view of a winding drum constructed in accordance with a first embodiment of the invention.

A first embodiment of the invention is described in connection with FIG. 2, which shows an apparatus 10 used to wind strips of slit material. The apparatus 10 includes a winding drum 100 mounted on an arbor 200 and adapted to receive pressurized fluid from a fluid source 142 for distribution along the outer winding surface 110 of the drum. It is understood that the arbor 200 may be connected to a motor system (not shown) used to rotate the arbor and the winding drum 100 as a unit.

The drum 100 may be constructed of steel so as to provide adequate support for the heavy loads it is required to withstand. The drum outer winding surface 110 may be chrome-plated (e.g. using an Armoloy coating) and/or ground to a high finish to provide a high degree of lubricity and a hardness value in the range of 70 to 72. Whether coated or not, it is preferable that the winding surface 110 be very smooth so that friction between the winding surface and the material wound thereon is minimized.

The drum 100 may include slots 150 extending substantially the entire longitudinal dimension of the drum winding surface 110. The slots 150 may communicate with the interior of the drum 100 through one or more holes 155 extending from the bottom of the slots into the drum winding surface 110. The slots 150 preferably do not extend through the entire thickness of the winding surface 110 because this could weaken the drum's ability to withstand the loads applied to it during a winding operation. The drum 100 may also include first and second ends 120 and 130 which provide additional support for the drum.

Figure 3:
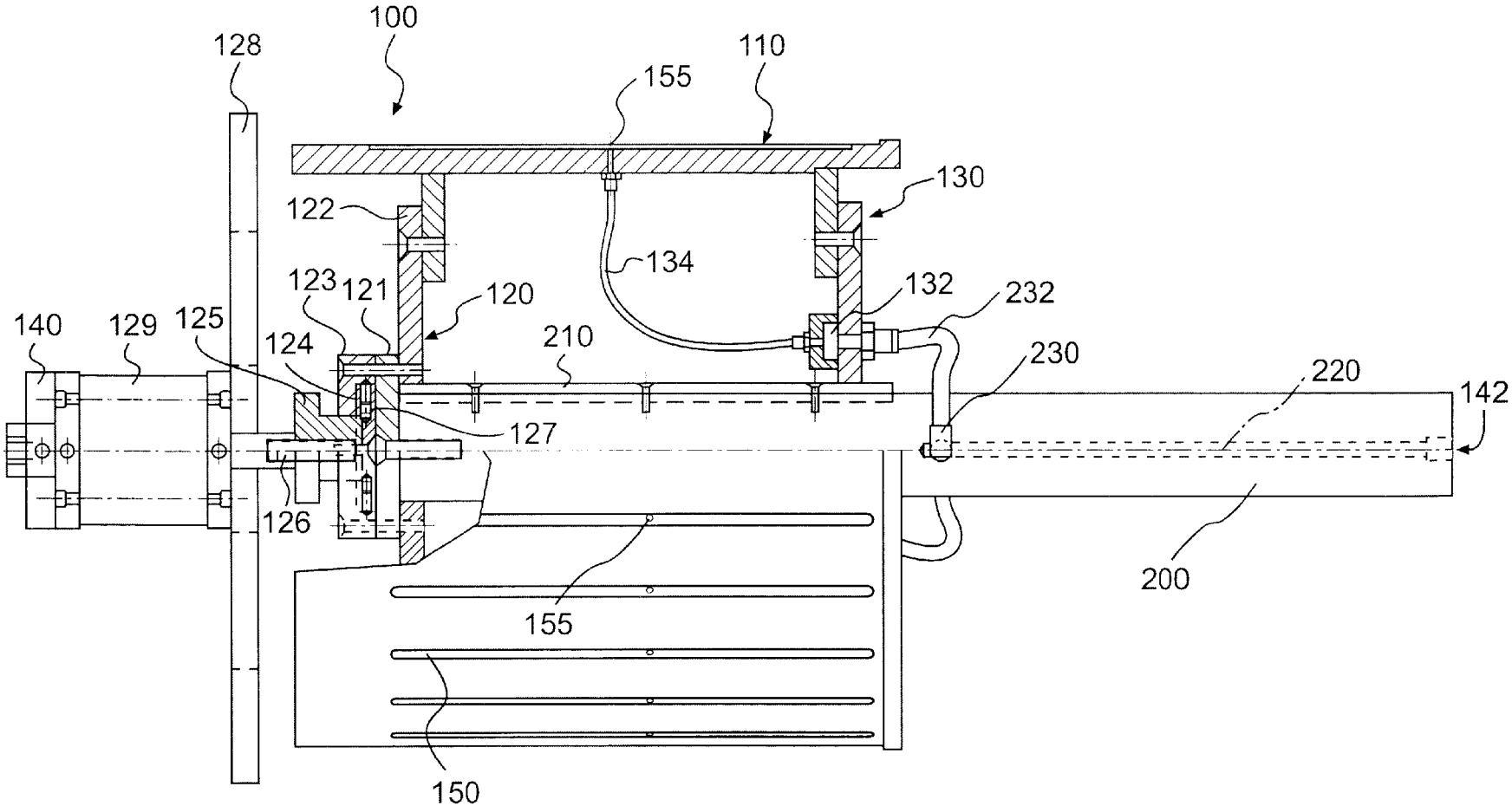
FIG. 3 is a partial cross section of the winding drum shown in FIG. 2.
Figure 4:
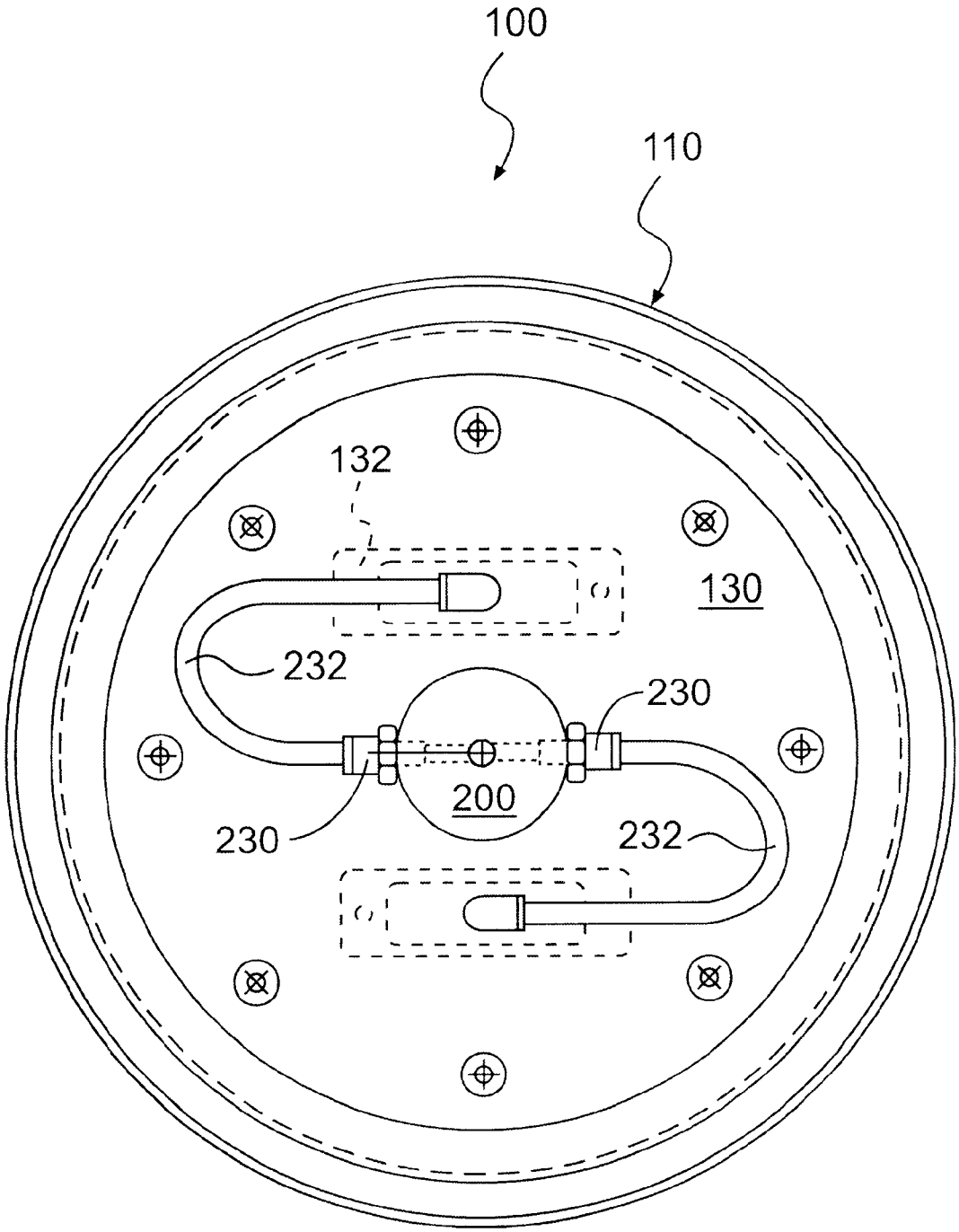
FIG. 4 is an end view of the winding drum shown in FIG. 3 showing external features of the end.
Figure 5:
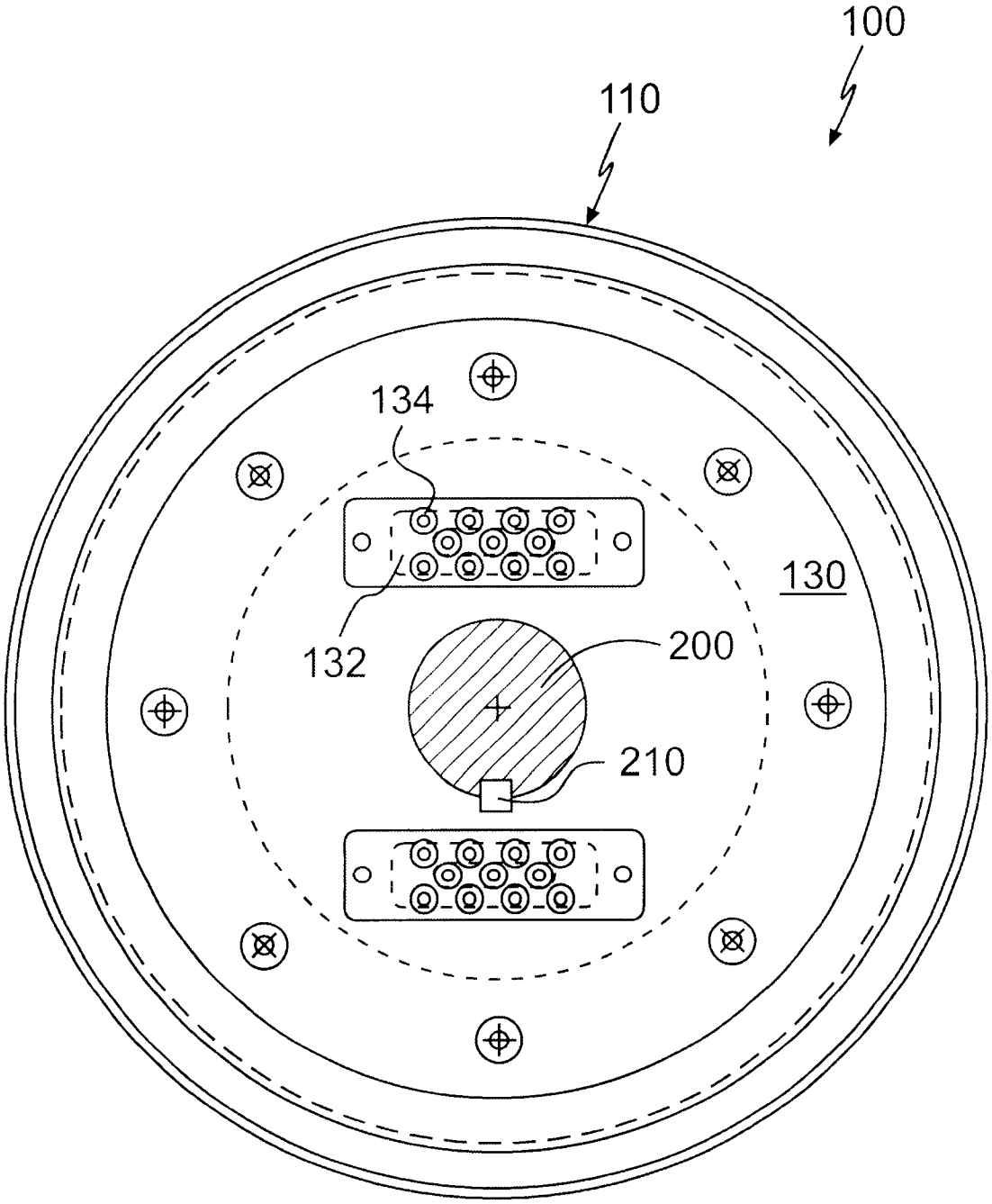
FIG. 5 is an end view of the winding drum shown in FIG. 3 showing internal features of the end.

The drum 100 is shown in cross section in FIG. 3 and in end views in FIGS. 4 and 5, and in which like reference numerals refer to like elements. The drum 100 may be locked to the arbor 200 with a key 210 that engages notches in the arbor and the drum ends 120 and 130. The key 210 may be fixed to the arbor 200, but unfixed relative to the drum 100, enabling empty drums to be slid onto the arbor and full drums to be slid off of the arbor.

With specific reference to FIG. 3, the first end 120 of the drum 100 includes a number of separate elements that collectively provide a means for applying lateral pressure to the material to be wound on the drum 100. The first end 120 includes an end cap 121, a circular end plate 122, a receiver 123, a crosspiece 124, a knurled knob 125, a stud 126, a ball plunger 127, a pressure disc 128, and a fluid cylinder 129. The pressure disc 128 (preferably made of aluminum) is supported by the stud 126. The fluid cylinder 129 is attached to the pressure disc 128. A rotary fluid coupling 140 may be connected to the fluid cylinder. The rotary fluid coupling 140 may be supplied with pressurized fluid, such as air, from a fluid source (not shown) which causes the fluid cylinder 129 to push the pressure disc 128 against material wound on the drum 100. This lateral pressure may be used to control slip between the strips of material wound on the drum.

With renewed reference to FIGS. 3, 4 and 5, fluid dispersed on the surface of the drum 100 is fed from the second end 130 of the drum. Fluid may be supplied through a central passage 220 in the arbor 200 to one or more arbor fittings 230. The one or more arbor fittings 230 may be connected by external hoses 232 to one or more second end fittings 132. Each of the second end fittings 132 may provide connection between one external hose 232 and a plurality of individual internal hoses 134. Each of the internal hoses 134 may be connected to a hole 155.

Figure 6:
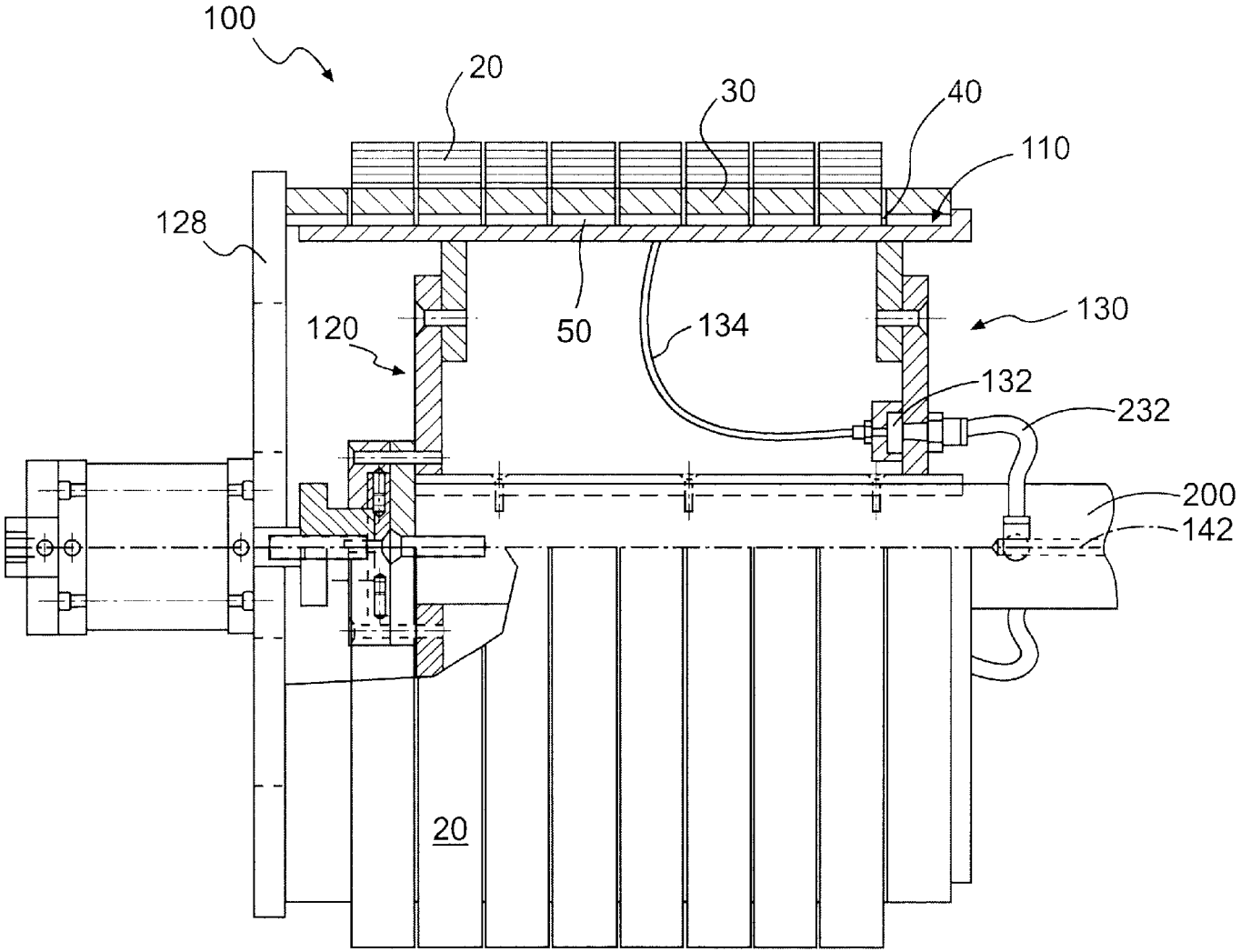
FIG. 6 is a partial cross section of the winding drum shown in FIG. 3 showing material wound thereon.

With reference to FIG. 6 in which like reference numerals refer to like elements, individual strips 20 of slit material may be wound on the apparatus 10 as follows. The strips may be initially taped or fixed by another temporary means to the core inserts 30 that are preferably made of cardboard. The drum 100 may then be rotated by the arbor 200 so that the strips 20 are taken up and wound onto the drum. As the drum 100 is rotated, pressurized fluid, such as air, is supplied through the central passage 220, arbor fittings 230, external hose 232, second end fittings 132, internal hoses 134, and holes 155 to the slots 150. The fluid provided to the slots 150 is distributed onto the drum winding surface 110 and lifts the core inserts 30 off of the surface such that a fluid bed 50 is created between the winding surface and the core inserts. The existence of this fluid bed reduces friction between the drum winding surface 110 and the wound material, and permits the wound material to slip relative to the drum winding surface.

Each of the core inserts 30 may be separated from the neighboring insert by a divider 40. Control over the slip between the core inserts 30 and the winding surface 110 is exercised by controlling the amount of lateral pressure applied by the plate 128 to the core inserts. Increased lateral pressure on the core inserts 30 increases friction and decreases the relative amount of slip between the core inserts and the winding surface. Control may be exercised such that each strip 20 of material wound onto the drum 100 may slip to the degree necessary to keep the tension applied to the strips relatively uniform. Means may be included for constant adjustment of the lateral pressure applied to the core inserts depending upon coil weights. Typically, lateral pressure may be set such that the rotational speed of the drum 100 is approximately ten (10) percent greater than the rotational speed of the wound material.

When the fluid supplied to through the central passage 220 of the arbor is air, the pressure supplied is kept relatively constant at a level in the approximate range of 80 to 120 psi. This pressure may be set as needed depending upon the density, thickness, width, and inherent "stickiness" of the core inserts.

In an alternative embodiment of the invention, the fluid supply 142 may provide a fluid(s) other than air in addition to air, or instead of air. For example, mixtures of air and vegetable oil based fluids are contemplated.

It will be apparent to those skilled in the art that various modifications and variations may be made in the preparation and configuration of the present invention without departing from the scope and spirit of the present invention. For example, the arrangement of holes and slots in the drum winding surface may be modified so long as some means for transferring pressurized fluid to the winding surface is provided. Furthermore, the individual components used to supply pressurized fluid to the drum slots may also be modified, eliminated, or added to, so long as some means for supplying pressurized fluid to the slots and/or the drum winding surface is provided. Thus, it is intended that the present invention cover all of the modifications and variations of the invention so long as they come within the scope of the following claims.

I claim:

1. An apparatus for winding strips of material comprising:

a drum adapted to rotate about a longitudinal axis, said drum having a winding surface;

a plurality of openings provided in the drum winding surface, said openings spaced at a plurality of positions around the winding surface; and a means for supplying pressurized fluid to the openings during winding of the strips of material on the drum.

2. The apparatus of claim 1 further comprising a means for adjusting the pressure of pressurized fluid supplied to the openings.

3. The apparatus of claim 1 wherein the means for supplying is adapted to supply pressurized air to the openings.

4. The apparatus of claim 1 wherein at least a portion of the plurality of openings comprise slots extending along the drum winding surface substantially parallel to the drum longitudinal axis.

5. The apparatus of claim 4 wherein the slots extend for substantially the entire longitudinal dimension of the drum winding surface.

6. The apparatus of claim 1 wherein at least a portion of the plurality of openings comprise holes spaced along the drum winding surface.

7. The apparatus of claim 1 wherein the means for supplying pressurized fluid to the openings is adapted to supply fluids at a pressure in the range of approximately 80 to 120 psi.

8. The apparatus of claim 1 wherein the winding surface is chrome plated.

9. The apparatus of claim 1 wherein the winding surface has a hardness in the range of 70 to 72 on the Rockwell scale.

10. The apparatus of claim 1 wherein each opening comprises an elongated slot formed in the winding surface and at least one hole extending from the slot to the drum interior.

11. An apparatus for winding strips of material comprising:

a drum adapted to rotate about a longitudinal axis, said drum having a winding surface;

a plurality of openings provided in the drum winding surface; and a means for supplying pressurized fluid to the openings, wherein the means for supplying is adapted to supply pressurized liquid to the openings.

12. An apparatus for winding strips of material comprising:

a drum adapted to rotate about a longitudinal axis, said drum having a winding surface;

a plurality of openings provided in the drum winding surface; and a means for supplying pressurized fluid to the openings, wherein the means for supplying is adapted to supply a mixture of pressurized air and liquid to the openings.

13. An apparatus for winding strips of material comprising:

a drum adapted to rotate about a longitudinal axis, said drum having a winding surface;

a plurality of openings provided in the drum winding surface;

a means for supplying pressurized fluid to the openings; and a central arbor supporting the drum, and wherein the means for supplying pressurized fluid to the openings comprises:

a pressurized fluid source;

a passage through the arbor connected to the pressurized fluid source; and one or more hoses connecting the passage to each of the openings.

14. An apparatus for winding strips of material fed to the apparatus from a slitting machine, said apparatus comprising:

a rotary arbor;

a drum having an interior and a winding surface, said drum removably mounted on the rotary arbor;

a plurality of openings providing communication between the drum interior and the drum winding surface, said openings spaced around the winding surface;

a pressurized fluid source; and at least one pressurized fluid passage connecting the pressurized fluid source to the openings for delivery of pressurized fluid to the openings during winding of the strips of material.

15. The apparatus of claim 14 further comprising a means for adjusting the pressure of fluid supplied to the openings.

16. The apparatus of claim 15 wherein at least a portion of the plurality of openings comprise slots extending along the drum winding surface substantially parallel to the drum longitudinal axis.

17. The apparatus of claim 16 wherein the slots extend for substantially the entire longitudinal dimension of the drum winding surface.

18. The apparatus of claim 17 wherein each of the openings further includes a hole providing fluid communication between each slot and the drum interior.

19. The apparatus of claim 18 wherein the winding surface is chrome plated.

20. The apparatus of claim 14 wherein the at least one fluid passage includes a passage through the arbor.

21. The apparatus of claim 14 wherein the pressurized fluid source is a pressurized air source.

22. The apparatus of claim 14 wherein the pressurized fluid source is a pressurized liquid source.

23. The apparatus of claim 14 wherein the pressurized fluid source is a pressurized air source and a pressurized liquid source.

24. A method of controlling the amount of friction between the winding surface of a drum and a plurality of material strips wound around said drum, said method comprising the steps of:

providing a core insert around the drum winding surface;

winding a strip of material around the core insert; and providing fluid between the winding surface and the core insert during the winding step to substantially reduce friction between the drum winding surface and the core insert.

25. The method of claim 24 wherein the step of providing fluid comprises the step of providing air between the winding surface and the core insert.

26. The method of claim 24 wherein the step of providing fluid comprises the step of providing liquid between the winding surface and the core insert.

27. The method of claim 24 wherein the step of providing fluid comprises the step of providing a mixture of air and liquid between the winding surface and the core insert.

28. A method of reducing the amount of friction between the winding surface of a drum and a plurality of material strands wound around said drum, said method comprising the steps of:

winding at least two strands of material around a core insert disposed over the drum winding surface; and supplying above ambient pressurized fluid to the winding surface during the winding step to substantially reduce friction between the winding surface and the core insert.

* * * * *